US011369232B2

(12) United States Patent
Fabre et al.

(10) Patent No.: US 11,369,232 B2
(45) Date of Patent: Jun. 28, 2022

(54) SEAT SYSTEM

(71) Applicants: Blake Fabre, Ponchatoula, LA (US); Danielle Fabre, Ponchatoula, LA (US)

(72) Inventors: Blake Fabre, Ponchatoula, LA (US); Danielle Fabre, Ponchatoula, LA (US)

( * ) Notice: Subject to any disclaimer, the term of this patent is extended or adjusted under 35 U.S.C. 154(b) by 225 days.

(21) Appl. No.: 16/812,543

(22) Filed: Mar. 9, 2020

(65) Prior Publication Data

US 2020/0281413 A1 Sep. 10, 2020

Related U.S. Application Data

(60) Provisional application No. 62/815,424, filed on Mar. 8, 2019.

(51) Int. Cl.
*A47K 3/12* (2006.01)
*A47D 15/00* (2006.01)
*A47D 1/10* (2006.01)

(52) U.S. Cl.
CPC ..... *A47K 3/122* (2013.01); *A47D 1/10* (2013.01); *A47D 15/006* (2013.01); *A47K 3/127* (2013.01)

(58) Field of Classification Search
CPC ..... A47K 3/122; A47K 3/125; A47K 3/127; A47K 3/164
USPC ..... 4/572.1
See application file for complete search history.

(56) References Cited

U.S. PATENT DOCUMENTS

| | | | | | |
|---|---|---|---|---|---|
| 2,142,263 | A * | 1/1939 | Bentz | A47K 3/122 | 4/579 |
| 2,690,790 | A * | 10/1954 | Linden | B60N 2/286 | 297/255 |
| 3,272,554 | A * | 9/1966 | Simer | B60N 2/2839 | 297/256 |
| 3,288,502 | A * | 11/1966 | Romay | A47D 1/103 | 403/78 |
| 4,837,869 | A | 6/1989 | Simmon | | |
| 5,307,527 | A | 5/1994 | Schober | | |
| 5,333,322 | A | 8/1994 | Weir | | |
| 6,637,045 | B1 | 10/2003 | Larsen | | |
| 7,810,180 | B2 | 10/2010 | List | | |
| 8,783,765 | B1 | 7/2014 | Matus et al. | | |
| 2017/0079437 | A1* | 3/2017 | Micol | A47D 1/02 | |

* cited by examiner

*Primary Examiner* — Huyen D Le
(74) *Attorney, Agent, or Firm* — Boudwin Intellectual Property; Daniel Boudwin

(57) ABSTRACT

A system for securement of a baby within a bathtub. The system includes a seat attached to a frame. The seat includes a backrest, a base, and a harness, such that the harness can removably secure the baby within the backrest and the base of the seat. The frame includes a unitary rod that extends through a perimeter of the seat, and a pair of adjustable hook members. Each adjustable hook member can be widened or narrowed to snugly fit to a sidewall of the bathtub and be secured thereto by friction fit. Upon securement of the adjustable hook members to the sidewall of the bathtub and placement of the baby within the seat, the baby is safely secured to an interior of the sidewall for bathing or recreation.

17 Claims, 9 Drawing Sheets

SEAT SYSTEM

CROSS REFERENCE TO RELATED APPLICATIONS

This application claims priority under 35 U.S.C. § 119(e) to U.S. Provisional Application No. 62/815,424 filed on Mar. 8, 2019. The above identified patent application is incorporated by reference herein in its entirety to provide continuity of disclosure.

BACKGROUND OF THE INVENTION

The present invention relates to a seat system for securement of a baby within a bathtub. The system improves safety and stability of the baby when a caretaker bathes the baby or allows the baby to play in the bathtub.

Bathing a baby in a bathtub can be a difficult or potentially dangerous procedure. The baby requires constant and careful attention from a caretaker to ensure the baby does not flail about and strike his or her head on an object, such as a faucet of the bathtub. In addition, the caretaker must ensure that the baby does not inadvertently fall into the water such that the baby's head is fully or partially submerged, a serious drowning hazard as many babies are unable to steady themselves in the water and independently prevent drowning. Further, many caretakers enjoy bathing in the bathtub alongside the baby, but there is often limited space for the caretaker and the baby within an interior of the bathtub. The crowded space may provide limited enjoyment, and may even contribute to an increased risk of slipping and injuries.

Therefore, there is a need in the art for a seat system for securement of a baby within a bathtub. The present invention addresses this unmet need.

Devices have been disclosed in the art that relate to baby seats. These include devices that have been patented and published in patent application publications. These devices are often unable to securely fasten to a sidewall of a bathtub to facilitate bathing of a baby secured therein. In view of the devices disclosed in the art, it is submitted that there is a need in the art for an improvement to existing seat systems for bathing babies. In view of the present disclosure, it is submitted that the present invention substantially diverges in structural and functional elements from devices in the art, and substantially fulfills an unmet need.

SUMMARY OF THE INVENTION

In view of the disadvantages inherent in the known types of baby seat systems in the art, the present invention provides a new and improved system for securement of a baby within a bathtub, wherein the same can be utilized for improving the safety and security associated with bathing the baby.

It is therefore an object of the present invention to provide a seat system for bathing the baby in the bathtub.

In one aspect, the invention provides a system for securement of a baby within a bathtub, comprising a seat and a frame. The seat comprises a backrest, a base, and a harness, and the frame comprises a unitary rod that extends through a perimeter of the seat, and a plurality of adjustable hook members that can be removably secured to a sidewall of the bathtub to removably secure the system thereto. During use of the system, the baby is placed within the seat, and the frame is secured to the sidewall of the bathtub to secure the baby thereto.

In another aspect, the invention provides a frame for the system, comprising a unitary rod that is configured to extend through a perimeter of a seat. The frame includes a plurality of adjustable hook members that can be removably secured to a sidewall of the bathtub to removably secure the system thereto. In such embodiments, a first portion of the unitary rod is mostly planar, a second portion of the unitary rod is mostly cylindrical, and a third portion of the unitary rod is mostly planar. The first and third portions correspond to a base of the seat, and the second portion corresponds to a backrest of the seat. In this manner, the seat is structurally reinforced by the frame to effectively secure the baby within the seat and to the sidewall of the bathtub.

The seat may further comprise a headrest affixed to the backrest. In such embodiments, the headrest, the backrest, and the base are unitary in construction. In this manner, the baby can rest his or her head back against the headrest during a bathing session, and is not inclined to fall forward toward the surface of the water within the bathtub.

The harness may be a hip-type harness, such that the harness comprises a left frame attachment, a right frame attachment, and a central frame attachment. The frame attachments secure to the frame of the system and the harness secures about a hip of the baby. In such embodiments, during use of the system, a torso of the baby may be exposed for easy access for bathing by the caretaker. In some such embodiments, a size, such as a diameter, of the harness is adjustable to accompany a size of the hip of the baby. In this manner, the harness can be adjusted to securely fit to a small baby, an average baby, or a large baby. The adjustability of the harness is particularly desirable for ensuring a snug fit without being too tight around the baby's waist, so as to prevent the baby from escaping from the harness and falling into the water.

The unitary rod of the frame extends through the perimeter of the seat, and in certain embodiments the perimeter includes left and right portions of the base of the seat, and left and right portions of the backrest of the seat. In some such embodiments, the perimeter further includes left, right, and upper portions of the headrest of the seat. In certain embodiments, the perimeter may not include an inner portion of the base of the seat—the portion having the baby's legs thereon during use—so as not to constrict the baby's legs during use of the system. In some such embodiments, portions of the unitary rod within the left and right portions of the base are planar or mostly planar. This design may impart a certain flexibility into these portions of the unitary rod, and in this manner, the frame may bend slightly during use so as to not be too rigid and so as to allow the baby to move about to a certain degree.

The adjustable hook members of the frame each comprises an inner member affixed to the unitary rod, and an outer member affixed to the inner member. During use of the system, the inner member is secured against an interior surface of the sidewall of the bathtub, and the outer member is secured against an exterior surface of the sidewall of the bathtub. In this manner, the baby is secured thereto during the bathing session. A distance between the inner member and the outer member may be adjustable to fit the frame to a variety of differently sized and/or shaped bathtub sidewalls.

In various embodiments, each adjustable hook member contacts the bathtub sidewall at three positions: the exterior surface of the sidewall, the interior surface of the sidewall, and an upper surface of the sidewall. The interior and upper surface contacts may be accomplished by a vertical portion of the inner member and a lower horizontal portion that extends inward from a curved portion of the inner member, respectively. The exterior surface contact may be accomplished by the outer member. In addition, each of the contact points may include a non-slip grip material thereon, so as to reduce slippage of the system during use.

Another object of the present invention is to provide a seat system that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
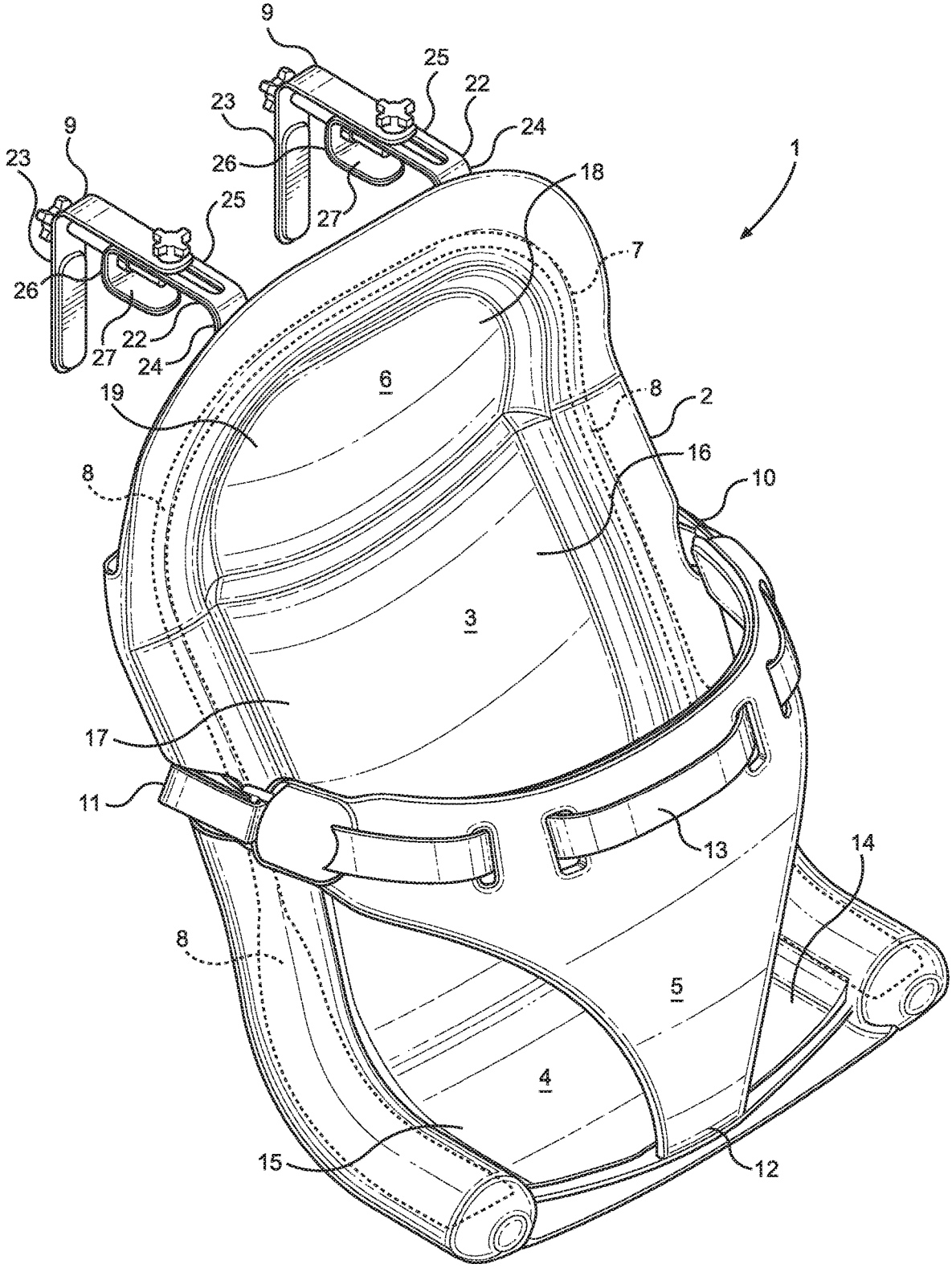
FIG. 1 depicts a perspective view of an exemplary seat system, according to the present invention.
Figure 2:
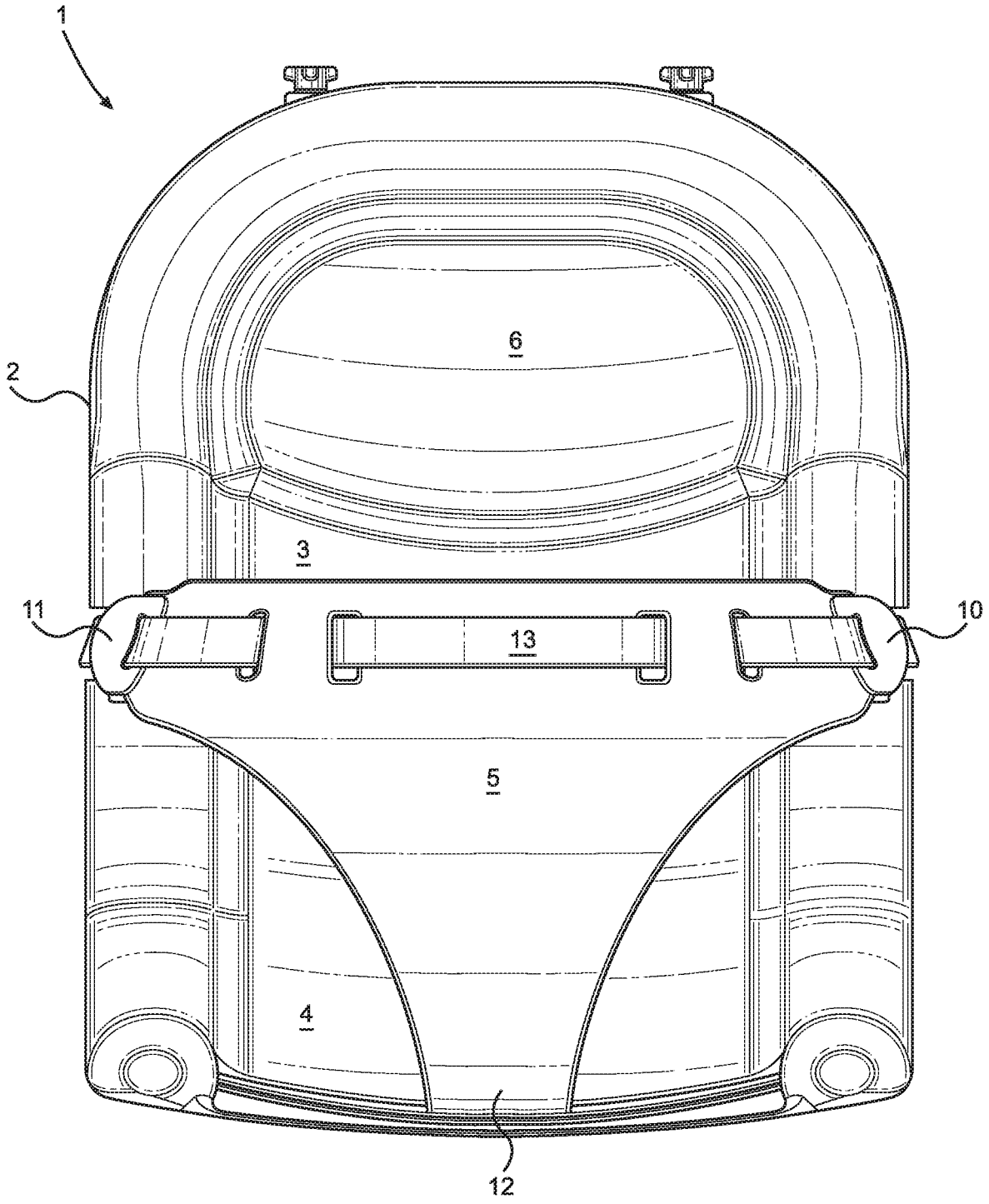
FIG. 2 depicts a front perspective view of the seat system.
Figure 3:
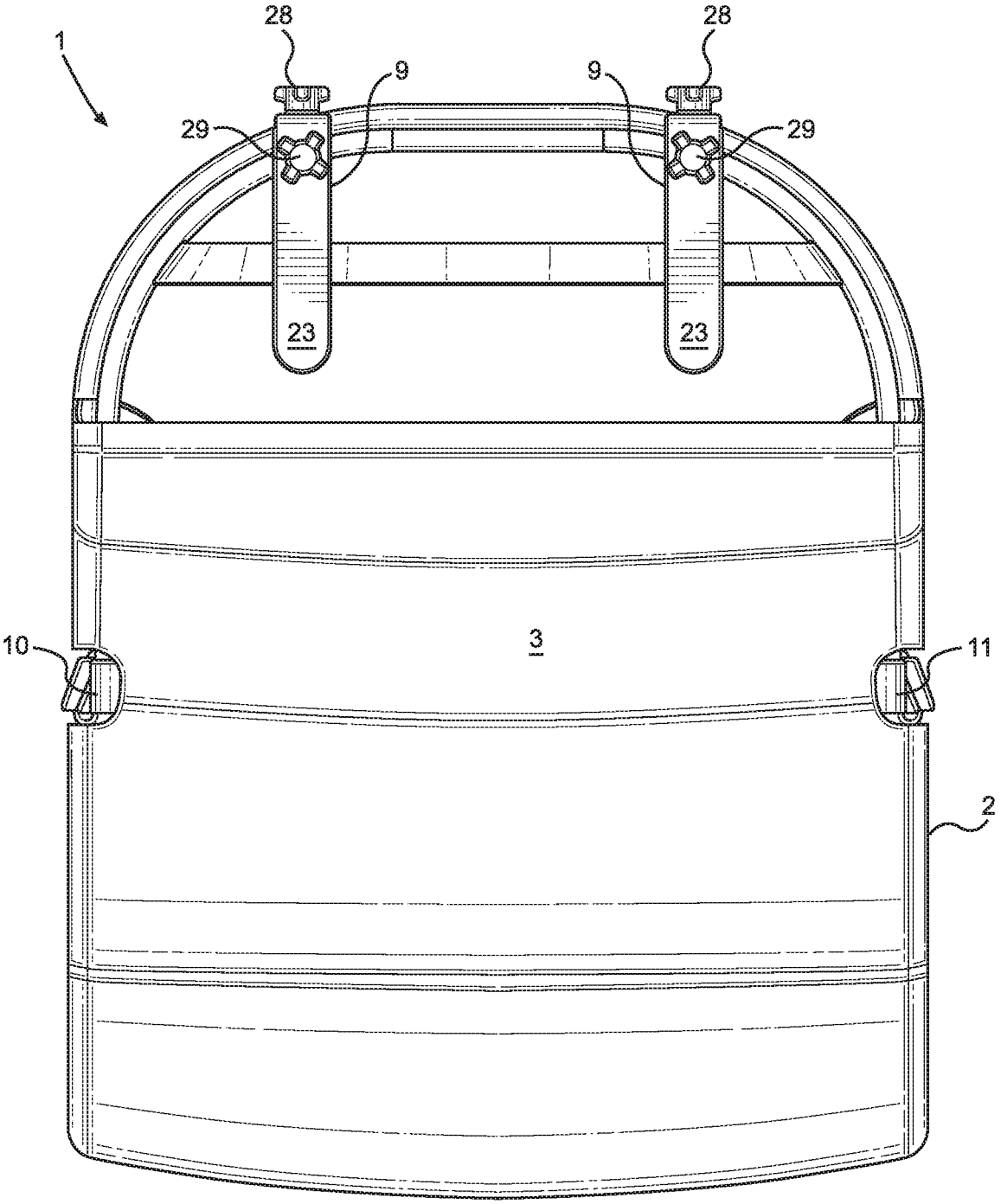
FIG. 3 depicts a rear perspective view of the seat system.
Figure 4:
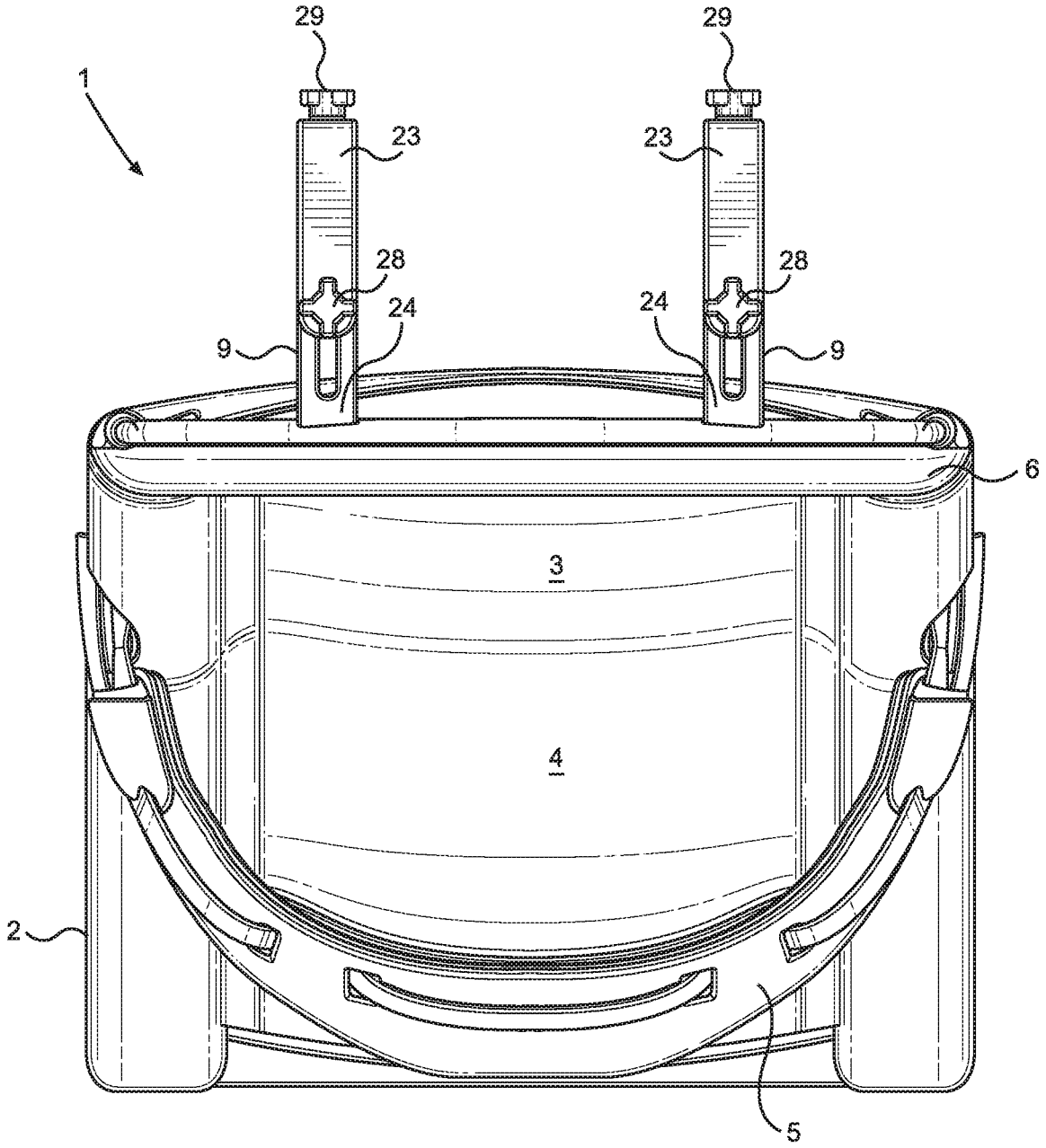
FIG. 4 depicts a top perspective view of the seat system.
Figure 5:
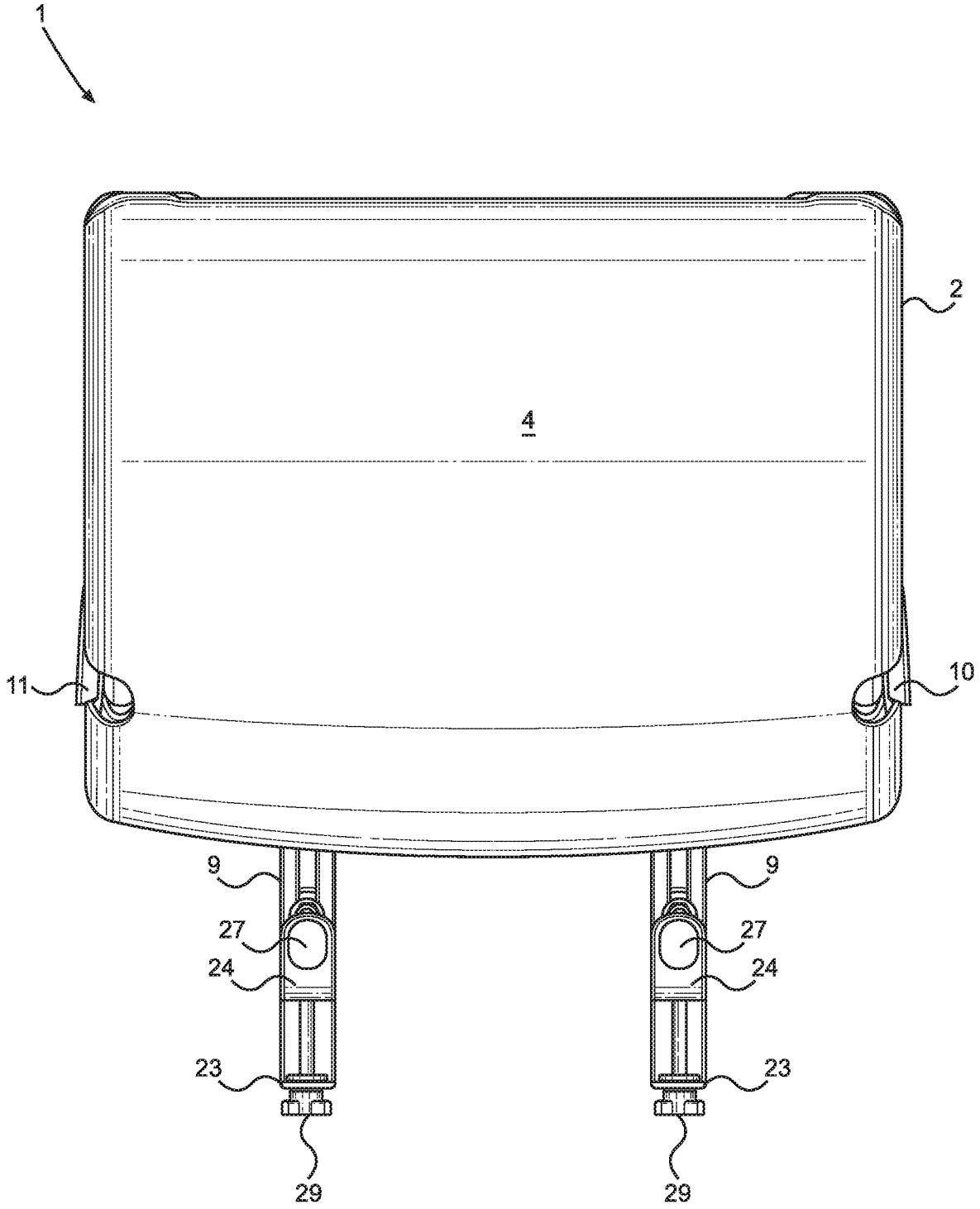
FIG. 5 depicts a bottom perspective view of the seat system.
Figure 6:
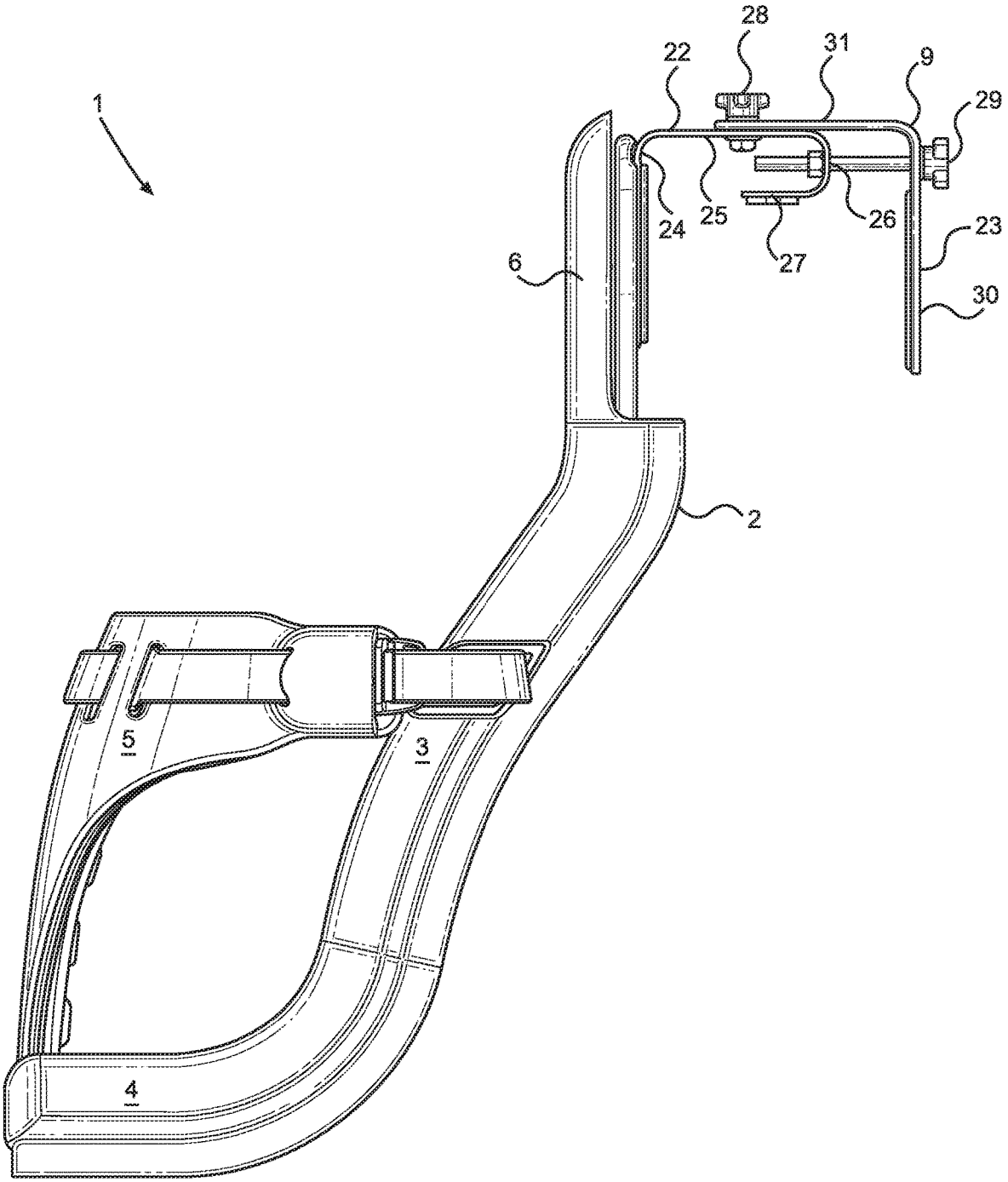
FIG. 6 depicts a left side perspective view of the seat system.
Figure 7:
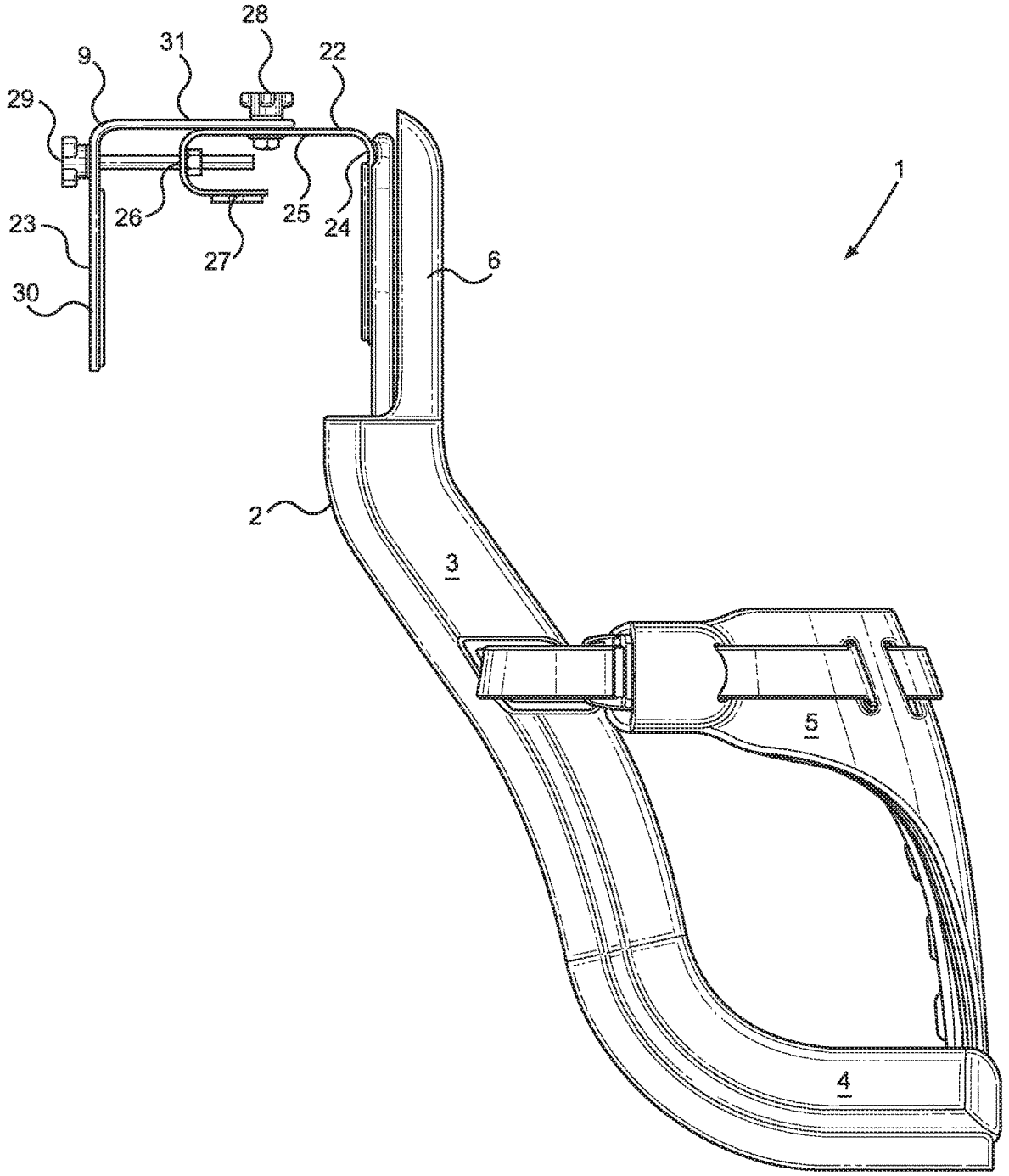
FIG. 7 depicts a right side perspective view of the seat system.

Reference is made herein to the attached drawings. Like reference numerals are used throughout the drawings to depict like or similar elements of the invention. The figures are intended for representative purposes only and should not be considered limiting in any respect.

Referring now to FIGS. 1-7, there are depicted several perspective views of an exemplary seat system, according to the present invention. The invention provides a system 1 for securement of a baby within a bathtub, which comprises a seat 2 and a frame 7. The seat 2 comprises a backrest 3, a base 4, and a harness 5, and the frame 7 comprises a unitary rod 8 that extends through a perimeter of the seat 2. The frame 7 also comprises a plurality of adjustable hook members 9 that can be removably secured to a sidewall of the bathtub to removably secure the system 1 thereto. To use the system 1, the frame 7 is secured to the sidewall of the bathtub, and the baby is placed within the seat 2 to secure the baby to the bathtub for a bathing session.

The seat 2 comprises a headrest 6 affixed to the backrest 3. The headrest 6, the backrest 3, and the base 4 are unitary in construction, and in this manner, the baby can rest his or her head back against the headrest 6 during the bathing session. By allowing the baby to rest his or her head on the headrest 6, the baby may not be inclined to lean or fall forward toward the water, and a risk of drowning may be minimized.

The harness 5 is a hip-type harness, configured to wrap across a waist of the baby and secure the waist to the seat 2. The harness 5 includes a left frame attachment 10, a right frame attachment 11, and a central seat attachment 12. The frame attachments (10, 11) secure to the frame 7 of the system 1, the central seat attachment 12 secures to the seat 2 of the system 1, and the harness 5 secures about a hip of the baby. In such embodiments, during use of the system 1, a torso of the baby may be exposed to facilitate cleaning by the caretaker. A size of the harness 5 is adjustable, e.g., by adjustment of one or more straps 13 placed thereon, to accompany any of a range of different sizes and shapes of babies. In this manner, the harness 5 secures the baby to the seat 2 without being too tight or too loose, and the safety of the baby is maintained or increased during the bathing session.

The unitary rod 8 of the frame 7, shown in broken lines in FIG. 1, extends through an interior of the perimeter of the seat 2. In the shown embodiment, the perimeter of the seat 2 includes a left base portion 14, a right base portion 15, a left backrest portion 16, and a right backrest portion 17, as well as a left headrest portion 18, a right headrest portion 19, and an upper headrest portion (i.e., the portion between the left and right headrest portions 18 and 19). In the shown embodiment, the perimeter of the seat through which the unitary rod 8 extends does not include an inner portion of the base 4 of the seat 2, i.e., adjacent to the central frame attachment 12. This design may impart a certain flexibility into the system 1, the seat 2, and/or the unitary rod 8, and may be particularly advantageous to avoid restricting the baby's legs too much during use of the system 1. In this manner, the baby's legs may not "fall asleep" or otherwise become cramped during use. In addition, the baby is able to move his or her legs thereabout, to a certain degree, during the bathing session.

The adjustable hook members 9 of the frame 7 each comprises an inner member 22 affixed to the unitary rod 8, and an outer member 23 affixed, e.g., slidably affixed, to the inner member 22. During use of the system 1, the inner member 22 is secured against an interior surface of the sidewall of the bathtub, and the outer member 23 is secured against an exterior surface of the sidewall of the bathtub. In various embodiments, a distance between the inner member 22 and the outer member 23 is adjustable so as to enable the frame 7 to fit with any of a variety of differently sized and/or shaped bathtub sidewalls.

In the shown embodiment, the inner member 22 comprises a vertical portion 24 affixed to the unitary rod 8, an upper horizontal portion 25 that extends outward from the vertical portion 24, a curved portion 26, and a lower horizontal portion 27 that extends inward from the curved portion 26. During use of the system 1, each adjustable hook member 9 contacts the bathtub sidewall at three positions: the exterior surface of the sidewall (i.e., via the outer member 23), the interior surface of the sidewall (i.e., via the vertical portion 24 of the inner member 22), and an upper surface of the sidewall (i.e., via the lower horizontal portion 27 of the inner member 22).

In the shown embodiment, an inner surface of the outer member 23, a lower surface of the lower horizontal portion 27 of the inner member 22, and an outer surface of the vertical portion 24 of the inner member 22 each includes a non-slip material thereon, such as rubber, to increase friction between the frame 7 and the sidewall of the bathtub. In this manner, the system 1 is stably and removably secured to the sidewall of the bathtub, and does not inadvertently become detached during use. In addition, the non-slip material provides a cushion between the frame 7, which may be comprised of a hard or abrasive material, such as a metal or alloy, and the bathtub, which may be ceramic or may otherwise be scratched by the frame 7. In this manner, the bathtub is not damaged by use of the system 1.

In various embodiments, the distance between the inner member 22 and the outer member 23 is adjustable by a movement of a first fastener 28 slidably disposed through an elongated slot of the upper horizontal portion 25. In such embodiments, upon loosening of the first fastener 28, the outer member 23 may be partially or fully configured to slide along a length of the upper horizontal portion 25. For example, in FIG. 7, the outer member 23 may be slid toward the right side of the figure to decrease the distance between a vertical portion 30 of the outer member 23 and the inner member 22 (e.g., the vertical portion 24 of the inner member 22). After the outer member 23 is adjusted with respect to the inner member, the first fastener 28 may be tightened again so as to fix the distance between the outer member 23 and the inner member 22 for use. During the adjustment, a horizontal portion 31 of the outer member 23 is slid over the upper horizontal portion 25 of the inner member 22. The sliding includes movement of the first fastener 28 within the elongated slot of the upper horizontal portion 25 of the inner member 22. In this manner, the outer member 23 moves in a controlled fashion relative to the inner member 22, and does not freely disconnect therefrom.

In addition, or in the alternative, the distance between the inner member 22 and the outer member 23 is adjustable by a movement of a second fastener 29 slidably disposed through an aperture of the curved portion 26. In such embodiments, the second fastener 29 may be secured in place by any suitable means, such as a threaded bolt, disposed on the second fastener 29 adjacent to an inner surface of the aperture of the curved portion 26. Adjustment of the second fastener 29 may be made in combination with an adjustment of the first fastener 28. In such embodiments, the inner member 22 is attached to the outer member 23 by two attachment sites, i.e., the first and second fasteners 28, 29.

The first fastener 28 is configured to affix the outer member 23 to the inner member 22 such that the outer member 23 does not slide inward or outward (i.e., rightward or leftward of FIG. 7, respectively), but may not necessarily be designed to prevent the outer member 23 from rotating about a vertical axis of the first fastener 28. To secure the rotational position of the outer member 23 to the inner member 22, the second fastener 29 may be included in a particular design or embodiment. In this manner, the pair of fasteners secures the outer member 23 to the inner member with respect to the horizontal axis, the vertical axis, and the z-axis (e.g., with respect to the orientation depicted in FIG. 7). By locking the outer member 23 and the inner member 22 together, a stability of the system 1 is improved or maximized, and the safety thereof is likewise enhanced. In this manner, the system 1 does not loosen and become detached from the sidewall of the bathtub during use, and the baby is safer as a result.

Figure 8:
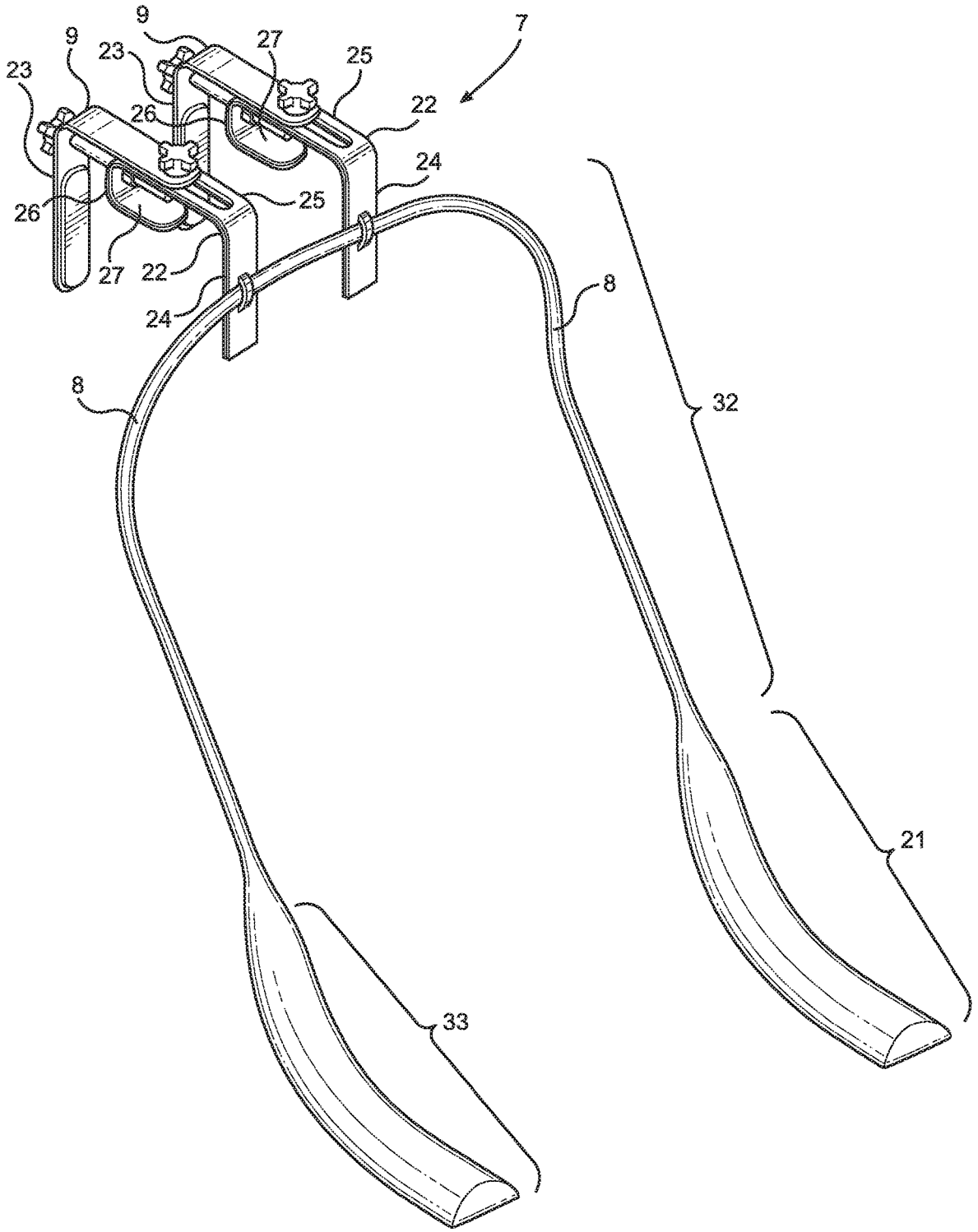
FIG. 8 depicts a perspective view of an exemplary frame of the seat system.
Figure 9:
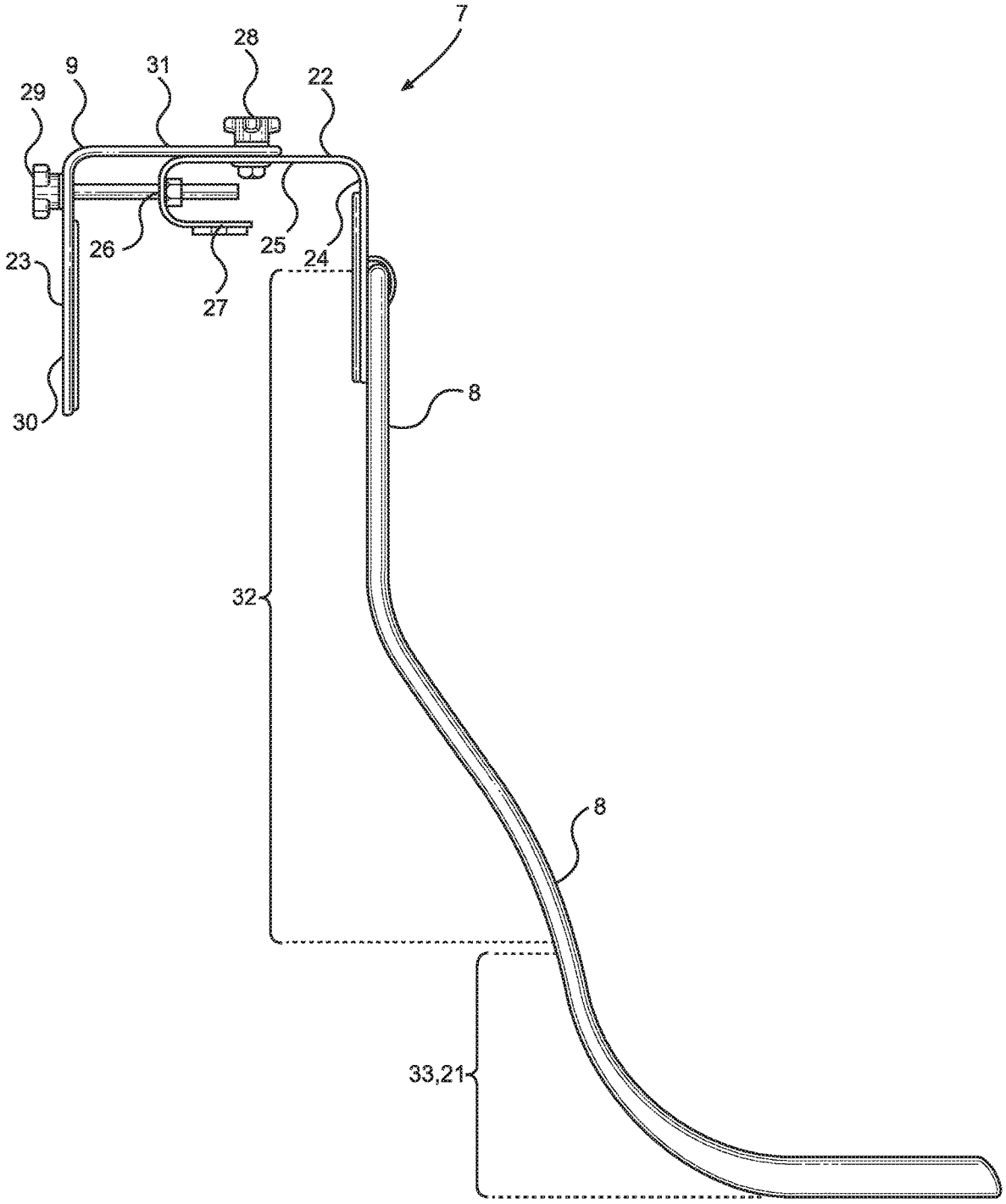
FIG. 9 depicts a right side perspective view of the frame of the seat system.

Referring now to FIGS. 8 and 9, there are depicted a perspective view (FIG. 8) and a right side perspective view (FIG. 9) of an exemplary frame of the seat system. The frame 7 of the system comprises the unitary rod 8, which is configured to extend through the perimeter of the seat, and the plurality of adjustable hook members 9 that can be removably secured to the sidewall of the bathtub to removably secure the system thereto. In the shown embodiment, a first portion 21 of the unitary rod 8 is mostly planar; e.g., flat or mostly flat on a lower surface thereof, and arcuately curved on an upper surface thereof, a second portion 32 of the unitary rod 8 is mostly cylindrical, and a third portion 33 of the unitary rod 8 is shaped substantially as the first portion 21. The first and third portions (21, 33) correspond to the base of the seat, and the second portion 32 corresponds to the backrest and/or the headrest of the seat. In this manner, the seat is structurally reinforced by the frame to effectively secure the baby within the seat and to the sidewall of the bathtub.

The first and third portions (21, 33) each comprises an arcuate shape that extends through the base of the seat when inserted therein, and the second portion 32 comprises an irregular arcuate shape that extends through the backrest of the seat and connects the first portion 21 to the third portion 33. In certain embodiments, a curvature of the unitary rod 8 may follow, or correspond with, a curvature of a spine of the baby. In this manner, the baby is effectively supported when sitting in the seat of the system, and injury or discomfort are prevented or avoided.

In the shown embodiment, each adjustable hook member of the plurality of adjustable hook members 9 comprises the inner member 22 affixed to the unitary rod 8, and the outer member 23 affixed, e.g., slidably affixed, to the inner member 22. The inner member 22 comprises the vertical portion 24, which is connected to the upper horizontal portion 25. The upper horizontal portion 25 is connected to the curved portion 26, which is in turn connected to the lower horizontal portion 27. The inner member 22 is unitary with respect to its portions, and in certain embodiments, may be engineered to have a certain degree of play, such that if the baby bounces in the seat during use of the system, the inner member 22 may bend at the curved portion 26 slightly to accompany the impact from the bounce. In this manner, forces ordinarily encountered by the frame 7, the seat, and the system during use cannot break the system or a component thereof.

The outer member 23 is comprised of the vertical portion 30, which contacts the exterior surface of the sidewall of the bathtub, and the horizontal portion 31, which slidingly engages the upper horizontal member 25 of the inner member 22. As described elsewhere herein, the distance between the inner member 22 and the outer member 23 is adjustable to accompany a width of the sidewall of the bathtub, which may vary depending on the design or manufacture of the bathtub. This adjustment may be performed by use of the first fastener 28 and the second fastener 29, which operate as described elsewhere herein.

As described elsewhere herein, the inner member 22 engages the interior surface of the sidewall of the bathtub, the outer member 23 engages the exterior surface of the sidewall of the bathtub, and the lower horizontal portion 27 engages the upper surface of the sidewall of the bathtub. The three points of contact provide greatly improved stability compared to a design that includes only one or two points of contact. In this manner, the system is effectively secured to the sidewall of the bathtub during use.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

We claim:

1. A system for securement of a baby within a bathtub, comprising:

a seat, comprising a backrest, a base, and a harness;

a frame, comprising a unitary rod that extends through a perimeter of the seat, and a plurality of adjustable hook members that can be removably secured to a sidewall of the bathtub to removably secure the system thereto;

wherein each adjustable hook member of the plurality of adjustable hook members comprises an inner member affixed to the unitary rod, and an outer member affixed to the inner member;

wherein a distance between the inner member and the outer member is adjustable to accompany a width of the sidewall of the bathtub;

wherein the inner member comprises a vertical portion affixed to the unitary rod, an upper horizontal portion that extends outward from the vertical portion, a curved portion, and a lower horizontal portion that extends inward from the curved portion.

2. The system of claim 1, wherein the seat further comprises a headrest affixed to the backrest, wherein the headrest, the backrest, and the base are unitary.

3. The system of claim 1, wherein the harness comprises a left frame attachment, a right frame attachment, and a central frame attachment, wherein the harness is configured to secure about a hip of the baby to hold the baby therein.

4. The system of claim 3, wherein a size of the harness is adjustable to accompany a size of the hip of the baby.

5. The system of claim 1, wherein the perimeter of the seat comprises a left portion of the base, a right portion of the base, a left portion of the backrest, and a right portion of the backrest.

6. The system of claim 5, wherein the perimeter of the seat further comprises a left portion, a right portion, and an upper portion of a headrest affixed to the backrest.

7. The system of claim 5, wherein portions of the unitary rod within the left portion of the base and the right portion of the base are mostly planar.

8. The system of claim 1, wherein the inner member engages an interior surface of the sidewall of the bathtub, wherein the outer member engages an exterior surface of the sidewall of the bathtub.

9. The system of claim 1, wherein the lower horizontal portion engages an upper surface of the sidewall of the bathtub.

10. The system of claim 9, wherein the distance between the inner member and the outer member is adjustable by a movement of a first fastener slidably disposed through an elongated slot of the upper horizontal portion.

11. The system of claim 9, wherein the distance between the inner member and the outer member is adjustable by a movement of a second fastener slidably disposed through an aperture of the curved portion.

12. A frame for a system for securement of a baby within a bathtub, comprising:

a unitary rod configured to extend through a perimeter of a seat;

a plurality of adjustable hook members that can be removably secured to a sidewall of the bathtub to removably secure the system thereto;

wherein a first portion of the unitary rod is mostly planar, wherein a second portion of the unitary rod is mostly cylindrical, wherein a third portion of the unitary rod is mostly planar.

13. The frame of claim 12, wherein the first portion and the third portion each comprises an arcuate shape that extends through a base of the seat, wherein the second portion comprises an irregular arcuate shape that extends through a backrest of the seat and connects the first portion to the third portion.

14. The frame of claim 12, wherein each adjustable hook member of the plurality of adjustable hook members comprises an inner member affixed to the unitary rod, and an outer member affixed to the inner member.

15. The frame of claim 14, wherein a distance between the inner member and the outer member is adjustable to accompany a width of a sidewall of the bathtub.

16. The frame of claim 15, wherein the inner member comprises a vertical portion affixed to the unitary rod, an upper horizontal portion that extends outward from the vertical portion, a curved portion, and a lower horizontal portion that extends inward from the curved portion.

17. The frame of claim 16, wherein the inner member engages an interior surface of the sidewall of the bathtub, wherein the outer member engages an exterior surface of the sidewall of the bathtub, and wherein the lower horizontal portion engages an upper surface of the sidewall of the bathtub.

* * * * *